US008235675B2

(12) United States Patent
Gianchandani et al.

(10) Patent No.: US 8,235,675 B2
(45) Date of Patent: Aug. 7, 2012

(54) SYSTEM AND METHOD FOR PROVIDING A THERMAL TRANSPIRATION GAS PUMP USING A NANOPOROUS CERAMIC MATERIAL

(75) Inventors: Yogesh B. Gianchandani, Ann Arbor, MI (US); Naveen Gupta, Ann Arbor, MI (US)

(73) Assignee: Yogesh B. Gianchandani, Ann Arbor, MI (US)

( * ) Notice: Subject to any disclaimer, the term of this patent is extended or adjusted under 35 U.S.C. 154(b) by 684 days.

(21) Appl. No.: 12/350,175

(22) Filed: Jan. 7, 2009

(65) Prior Publication Data

US 2009/0175736 A1 Jul. 9, 2009

Related U.S. Application Data

(60) Provisional application No. 61/020,126, filed on Jan. 9, 2008.

(51) Int. Cl.
*F04B 37/02* (2006.01)

(52) U.S. Cl. ..... 417/51

(58) Field of Classification Search ..... 417/51, 417/52–53

See application file for complete search history.

(56) References Cited

U.S. PATENT DOCUMENTS 5,464,798 A 11/1995 Jia et al.
5,611,846 A 3/1997 Overton et al.
5,789,024 A * 8/1998 Levy et al. ..... 427/244
5,871,336 A 2/1999 Young
6,533,554 B1 3/2003 Vargo et al.
7,367,781 B2 5/2008 Gianchandani et al.
2004/0244356 A1* 12/2004 Ronney ..... 60/200.1

OTHER PUBLICATIONS

Mark W. Ackely, Clinoptilolite: Untapped Potential for Kinetic Gas Seperations, Zeolites, 1992, vol. 12, Sep. /Oct., pp. 1-9.
Xavier Canet et al., Determination of the Henry Constant for Zeolite-VOC Systems Using Massic and Chromatographic Adsorption, Springer Science & Business Inc., Adsorption 11, 2005, pp. 213-216.
Stephane Colin, Rarefaction and Compressibility Effects on Steady and Transient Gas Flows in Microchannels, Microfluid Nanofluid, 2005, pp. 268-279.

(Continued)

*Primary Examiner* — Anh Mai
*Assistant Examiner* — Hana Featherly
(74) *Attorney, Agent, or Firm* — Jelic Patent Services, LLC; Stanley E. Jelic

(57) ABSTRACT

A system and method for using an element made of porous ceramic materials such as zeolite to constrain the flow of gas molecules to the free molecular or transitional flow regime. A preferred embodiment of the gas pump may include the zeolite element, a heater, a cooler, passive thermal elements, and encapsulation. The zeolite element may be further comprised of multiple types of porous matrix sub-elements, which may be coated with other materials and may be connected in series or in parallel. The gas pump may further include sensors and a control mechanism that is responsive to the output of the sensors. The control mechanism may further provide the ability to turn on and off certain heaters in order to reverse the flow in the gas pump. In one embodiment, the pump may operate by utilizing waste heat from an external system to induce transpiration driven flow across the zeolite. In another embodiment, the pump may selectively drive and direct gas molecules depending on the molecular size and the interaction between the gas molecule and the zeolite element.

15 Claims, 10 Drawing Sheets

OTHER PUBLICATIONS

Nai-Qian Feng et al., Applications of Natural Zeolite to Construction and Building Materials in China, Construction and Building Materials 19, 2005, pp. 579-584, www.elsevier.com/locate/conbuildmat.
H. Ghobarkar et al., Zeolites—From Kitchen to Space, Prog. Solid St. Chem. vol. 27, pp. 29-73 1999.
Naveen K. Gupta et al., Modeling and Simulation of a Surface Micromachined Knudsen Pump, IMECE2006-14940, 2006 ASME International Mechanical Engineering Congress and Exposition, Nov. 5-10, 2006, pp. 1-7.
Naveen K. Gupta et al., Gas Flow in Nano-Channels Thermal Transpiration Models with Application to a Si-Micromachined Knudsen Pump, IEEE Explore, 2007, pp. 2329-2332.
Naveen K. Gupta et al., A Knudsen Pump Using Nanoporous Zeolite for Atomosphere Peressure Operation, Department of Mechanical Engineering, University of Michiga, Jan. 13-17, 2008, pp. 38-41.
Naveen K. Gupta et al., Thermal Transpiration in Zeolites: A Mechanism for Motionless Gas Pumps, Applied Physics Letters 93, 193511, Sep. 8, 2008, pp. 93-95.
Y.-L. Han et al., Experimental Investigation of Micro-Mesoscale Knudsen Compressor Performance at Low Pressures, American Vacuum Society, May/Jun. 2007, pp. 703-714.
J.P. Hobson et al., Review of Pumping by Thermal Molecular Pressure, Americal Vacuum Society Technologies, A 18(4), Jul./Aug. 2000, pp. 1758-1765.
W. Jia et al., Molecular Dynamics Simulations of Gas Separations Using Faujasite-Type Zeolite Membranes, Journal of Chemical Physics, vol. 120, No. 10, Mar. 8, 2004, pp. 4877-4885.
Basic Concepts and Technologies, 1.1 New Flow Regimes in Microsystems, pp. 1-48, 2005, Karniadakis.
Sabeha Kesraoui-Ouki et al., Natural Zeolite Utilisation in Pollution Control: A Review of Applications to Metals' Effluents, J. Chem. Tech. Biotechnol, 1994, 59, pp. 121-126.
Hanseup Kim et al., A Fully Integrated High-Efficiency Peristaltic 18-Stage Gas Micropump with Active Microvalves, Center for Wireless Integrated Microsystems (WIMS), University of Michigan, pp. 1-4, Jan. 2007.
Piotr Kowalczyk et al., Porous Structure of Natural and Modified Clinoptilolites, Journal of Colloid and Interface Science 297, 2006, pp. 77-85, www.elsevier.com/locate/jcis.
D.J. Laser et al., A Review of Micropumps, Journal of Micromechanics and Microengineering, 14, 2004, pp. R-35-R64.
The Kinetic Theory of Gases, Law of Rarefied Gases and Surface Phenomena, pp. 352-365, 1934; Loeb.
J. Clerk Maxwell, On Stresses in Rarified Gases Arising from Inequalities of Temperature, Philosophical Transactions of the Royal Society of London, vol. 170, 1879, pp. 231-256.
Shamus McNamara et al., A Micromachined Knudsen Pump for On-Chip Vacuum, Department of Electrical Engineering and Computer Science, University of Michigan, 4 pages, Jun. 2003.
Shamus McNamara, On-Chip Vacuum Generated by a Micromachined Knudsen Pump, Journal of Microelectromechanical Systems, vol. 14, No. 4, Aug. 2005, pp. 741-746.
G. Narin et al., Chemical Engineering Communications, A Chromatographic Study of Carbon Monoxide Adsorption on a Clinoptilolite-Containing Natural Zeolitic Material, Publisher: Taylor & Francis, 191:11, pp. 1525-1538, http://dx.doi.org/10.1080/00986440490472643, Nov. 2004.
Serpil Ozaydin et al., Energy Sources, Part A: Recovery, Utilization, and Environmental Effects, 28:15, Publisher: Taylor & Francis, Natural Zeolites in Energy Applications, pp. 1425-1431, http://dx.doi.org/10.108/15567240500400804, 2006.
Osborne Reynolds, On Certain Dimensional Properties of Matter in the Gaseous State. Part I. Experimental Researches on Thermal Transpiration of Gases through Porous Plates and on the Laws of Transpiration and Impulsion, Including an Experimental Proof that Gas is Not a Continuous Plenum. Part II. On an Extension of the Dynamical Theory of Gas, Which Includes the Stresses, Tangential and Normal Caused by a Varing Condition of Gas, and Affords an Explanation of the Phenomena of Transpiration and Impulsion, Philosophical Transactions of the Royal Society of London, vol. 170, 1879, pp. 727-845.
Kengo Sakaguchi et al., Applications of Zeolite Inorganic Composites in Biotechnology Current State and Perspectives, Appl. Microbiol Biotechnol, 2005, 67, pp. 306-311.
Felix Sharipov, Rarefied Gas Flow Through a Long Tube at Arbitrary Pressure and Temperature Drops, American Vacuum Society, J. Vac. Sci. Technol. A 15(4), Jul./Aug. 1997, pp. 2434-2436.
Felix Sharipov, Non-Isothermal Gas Flow Through Rectanular Microchannels, J. Micromech. Microeng. 9, 1993, pp. 394-401.
Panagiotis G. Smirniotis et al., Catalysis Review, Composite Zeolite-Based Catalysts and Sorbents, Publisher: Taylor & Francis, 41:1, pp. 43-113, Feb. 1999.
Yoshio Sone et al., Vacuum Pump without a Moving Part and its Performance, Department of Aeronautics and Astronautics, Kyoto University, Kyoto, pp. 1041-1048, 2003.
R.W. Triebe et al., Adsorption of Methane, Ethane and Ethylene on Molecular Sieve Zeolites, Gas. Sep. Purif. vol. 10, No. 1, 1996, pp. 81-84.
Stephen E. Vargo et al., Initial Results From the First MEMS Fabricated Thermal Transpiration-Driven Vacuum Pump, Dept. of Aerospace and Mechanical Engineering, University of Southern California, pp. 502-509, 2001.
Jens Weitkamp, Zeolites and Catalysis, Solid State Ionics 131, 2000, pp. 175-188.
C. Channy Wong et al., Gas Transport by Thermal Transpiration in Micro-Channels-A numerical Study, Sandia National Laboratories Engineering Science Center, 8 pages, 1998.
D.C. York et al., Thermal Transpiration of Heleum and Nitrogen in 50-μm Bore Silica Capillaries, Vacuum Surface Engineering, Surface Instrumentation & Vacuum Technology, Vacuum 59, 2000, pp. 910-918.
M. young et al., Characterization and Optimization of a Radiantly Driven Multi-Stage Knudsen Compressor, University of Southern California, Dept. of Aerospace and Mechanical Engineering, pp. 174-179, 2005.
Mark W. Ackley, Clinoptilolite: Untapped Potential for Kinetic Gas Separations, Zeolites, vol. 12, Sep./Oct. 1992, pp. 780-788.
Kinetic Theory of Gases, Chapter VII, Sec. 184, Properties of Gases at Low Densities, pp. 326-333, 1934; Loeb.

* cited by examiner

300

500

600

800

900

SYSTEM AND METHOD FOR PROVIDING A THERMAL TRANSPIRATION GAS PUMP USING A NANOPOROUS CERAMIC MATERIAL

PRIORITY CLAIM

This application claims priority to U.S. Provisional Patent Application No. 61/020,126 entitled "THE USE OF A ZEOLITE MATERIAL WITHIN THE FLOW CHANNEL OF A GAS PUMP BASED ON THERMAL TRANSPIRATION", which was filed on Jan. 9, 2008 by Yogesh B. Gianchandani, the contents of which are expressly incorporated by reference herein.

BACKGROUND

Pumps are devices used to move fluids, such as gases or liquids. Displacement of fluid is achieved by physical or mechanical means. Pumps may be used to evacuate gas from a confined space, thereby creating a vacuum. Conversely, pumps may also be used to draw in gas from one environment to another. In another example, pumps may be used to pressurize a sealed volume or to generate a pressure gradient along a restricted flow path.

Most pumps are not suitable for miniaturization as they possess mechanical parts or require a low backing pressure that makes it necessary to use a backing pump. Miniaturized pumps, such as micropumps and mesoscale pumps, can suffer from poor performance and reliability, or introduce undesired vibrations into a system.

Thermal transpiration pumps work by maintaining a temperature difference across an orifice under rarefied conditions. However, there is room for improvement in throughput, range of pressure under operating conditions, operating voltage, energy efficiency, and other aspects affecting cost, manufacturability and performance.

The foregoing examples of the related art and limitations related therewith are intended to be illustrative and not exclusive. Other limitations of the related art will become apparent upon a reading of the specification and a study of the drawings.

SUMMARY

The following examples and aspects thereof are described and illustrated in conjunction with systems, tools, and methods that are meant to be exemplary and illustrative, not limiting in scope. In various examples, one or more of the above-described problems have been reduced or eliminated, while other examples are directed to other improvements.

A technique provides a system and method for constraining gas molecules to the free molecular or transitional flow regime using nanoporous ceramic materials in gas pumps based on the principle of thermal transpiration.

A system based on the technique may comprise a single nanoporous ceramic element or may comprise multiple layers of one or more types of nanoporous ceramic materials. A temperature difference may be achieved across the nanoporous ceramic element by the use of one or more heaters, thereby creating a flow of gas molecules through the nanoporous ceramic element.

A method based on the technique may provide differential molecular pumping speeds for different gas molecules of varying sizes.

DETAILED DESCRIPTION

In the following description, several specific details are presented to provide a thorough understanding. One skilled in the relevant art will recognize, however, that the concepts and techniques disclosed herein can be practiced without one or more of the specific details, or in combination with other components, etc. In other instances, well-known implementations or operations are not shown or described in detail to avoid obscuring aspects of various examples disclosed herein.

A technique provides gas pumping by thermal transpiration using nanoporous ceramic materials to constrain the gas molecules to free molecular or transitional flow regime at pressures up to around atmospheric pressure. A method and system based on the technique may provide differential pumping rates for different gas molecules. The degree of differential pumping is determined primarily by the size of the gas molecules and their rates of interaction with the matrix of the nanoporous ceramic element.

In a non-limiting example, the nanoporous ceramic element may be zeolite. Zeolites are hydrated alumino-silicate minerals with an "open" structure with a large surface area to volume ratio. They are characterized by an interconnected network of nanopores, which are typically in the range of 0.3 nm to 10 nm. Zeolites can be naturally occurring or may be synthesized.

The Knudsen number (Kn), which is used as a parameter to characterize various gas flow regimes, is defined as the ratio of the mean free path of gas molecules (i.e. the average distance traveled by a molecule between two successive collisions) to the hydraulic diameter of the channel (i.e. the equivalent diameter to circular ducts). These flow regimes, which include free molecular, transitional, slip and viscous, correspond to $Kn>10$, $0.1<Kn<10$, $0.01<Kn<0.1$ and $Kn<0.01$, respectively. For the free molecular or transitional flow conditions to be satisfied at pressures near atmospheric pressure, the gas flow channels must have a hydraulic diameter ($d_h$) on the order of 100 nm or less.

A thermal transpiration driven vacuum pump, also known as Knudsen pump, works by the principle of thermal transpiration as manifest in the equilibrium pressures of two chambers that are maintained at different temperatures, while connected by a channel that permits gas flow in the free molecular or transitional flow regimes, but not in the viscous regime. By equating the molecular flux between these chambers, it can be shown that the idealized ratio of the pressures is related to the ratio of their absolute temperatures by:

$$\frac{P_2}{P_1} = \left(\frac{T_2}{T_1}\right)^{\frac{1}{2}}$$

A Knudsen pump has high structural efficiency because of the lack of moving parts. Thermal transpiration, the mechanism for a Knudsen pump, has its observable effects on the gas molecules flowing across the channels with Knudsen number (Kn) greater than 0.1.

Figure 1:
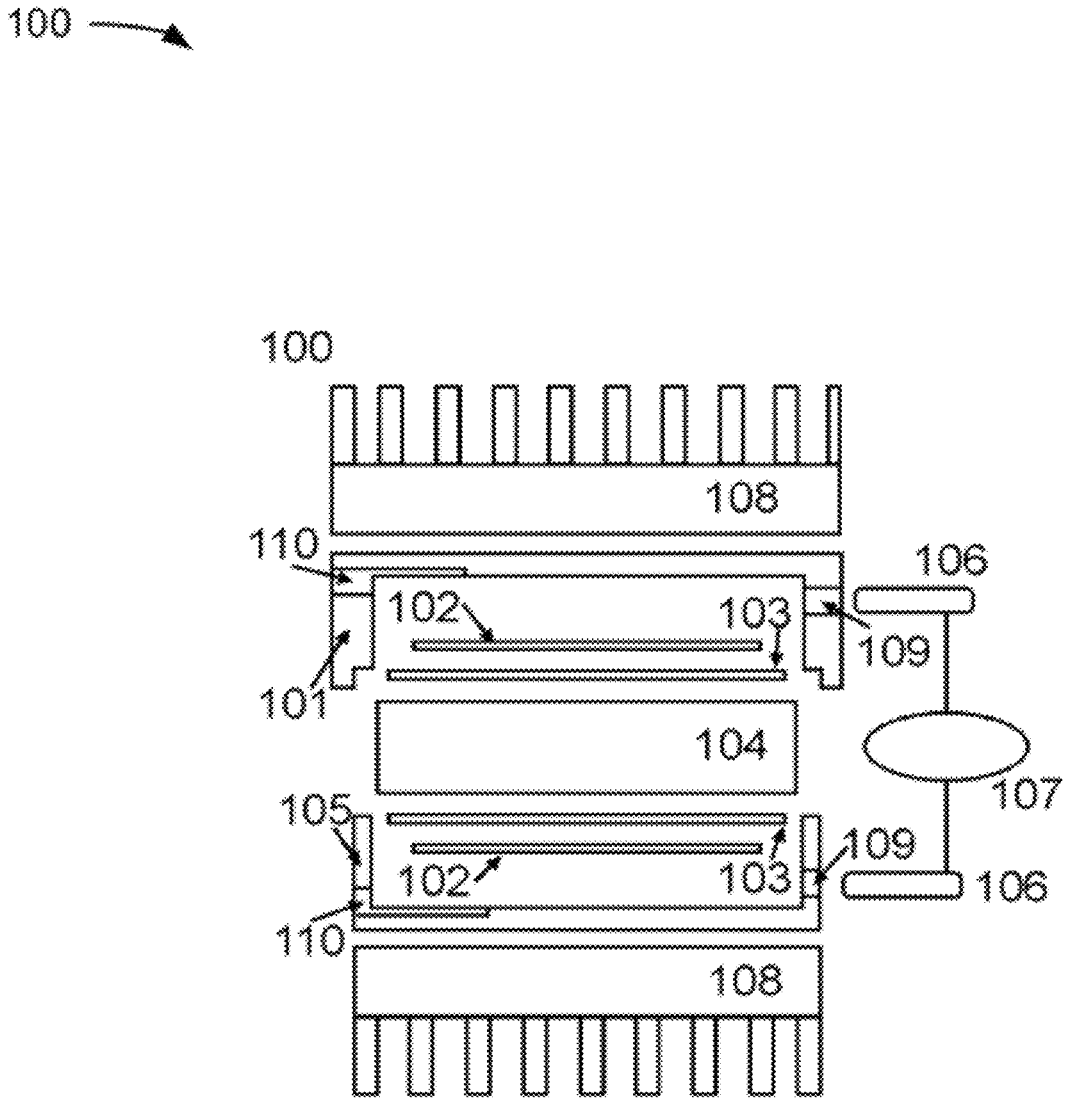
FIG. 1 depicts an exploded view of a thermal transpiration driven gas pump with a nanoporous ceramic element.

FIG. 1 depicts a diagram 100 of an exploded view of a thermal transpiration driven gas pump with a nanoporous ceramic element. FIG. 1 includes a first part of an encapsulation 101, a second part of an encapsulation 105, heaters 102, passive thermal elements 103, nanoporous ceramic element 104, sensors 106, feedback control 107, coolers 108, provisions for sensors 109, and ports 110.

In the example of FIG. 1, the nanoporous ceramic element 104 may be disposed within an encapsulation. In a non-limiting example, the encapsulation may include a first encapsulation 101 and a second encapsulation 105, which are configured to provide a seal around the nanoporous ceramic element 104 (with the exception of the inlet/outlet ports 110). The encapsulation may be bonded to the nanoporous ceramic element 104, thereby restricting gas molecules passing through the device to flow through the nanoporous ceramic element 104. Encapsulations 101 and 105 may be made of a thermally insulating material, such as polyvinyl chloride (PVC), to minimize the parasitic losses of heat from the device.

In the example of FIG. 1, the heaters 102 may be resistive heaters. The heaters can be operated in such a way as to create a temperature difference between two sides of the nanoporous ceramic element 104. A single heater may also be employed instead of two heaters as illustrated in FIG. 1. Alternatively, other mechanisms may be employed to provide the temperature difference, such as cooling the gas on one side of the nanoporous ceramic element 104 (for example, using coolers 108), using heat from a source outside of the device (such as scavenging waste heat from an independent system), or any other means of cooling or heating. The temperature difference may be created using at least one of the coolers 108 with at least one of the heaters 102 in conjunction or combination.

Coolers 108 may be finned conductors providing passive cooling or heat sinks with liquid pumped through for active cooling. Heaters 102 and coolers 108 may be selectively turned on to control the temperature difference across the nanoporous ceramic element 104, and to control the gas flow rate and/or direction of flow.

In the example of FIG. 1, passive thermal elements 103 are disposed on either side of the nanoporous ceramic element 104 within the encapsulation 101 and 105. The passive thermal elements 103 may be made of a material with high thermal conductivity, such as, in a non-limiting example, aluminum or silicon, and may have an array of holes through which a gas can flow. The size of the holes should be such that gas molecules within the passive thermal elements 103 are in the viscous flow regime. The high thermal conductivity of the passive thermal elements 103 and their proximity to heaters 102 means that the thermal elements 103 will reach a temperature close to that of the heaters 102. In another embodiment, a heater may be directly fabricated onto the passive thermal element 103, or the passive thermal element 103 may act as a heater and/or cooler itself.

The nanoporous ceramic element 104 has a plurality of interconnected molecular sized pores throughout the volume. In a non-limiting example, the nanoporous ceramic element 104 may consist of zeolite or a combination of zeolite and other materials. The zeolite may be naturally occurring or synthesized.

Sensors 106 may be disposed within provisions 109 to measure temperature, pressure, and/or flow rate across the nanoporous ceramic element 104. The pressure, temperature and flow rate data may be analyzed and used by the feedback control 107 to reversibly control the temperature difference and hence the gas flow rate across the nanoporous ceramic element 104.

In operation, a temperature difference may be maintained between two sides of a nanoporous ceramic element 104. The size of the pores of the ceramic element 104 constrains a gas to the free molecular or transitional flow regime within the matrix of the ceramic element 104, even if the gas is at atmospheric pressure. The temperature difference generates a flow across the nanoporous ceramic element 104 due to thermal transpiration. Heat transfer between the hot side and the cold side of the nanoporous ceramic element 104 is reduced due to the low thermal conductivity of the ceramic element 104, thus allowing for greater and more efficient temperature differences. Gas flowing through the device will enter the device through one of the ports 110. The passive thermal element 103 allows the gas to achieve a desired temperature before the gas reaches the nanoporous ceramic element 104.

Figure 2:
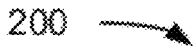
FIG. 2 depicts an alternative embodiment of a thermal transpiration driven gas pump using nanoporous ceramic elements.
Figure 2:
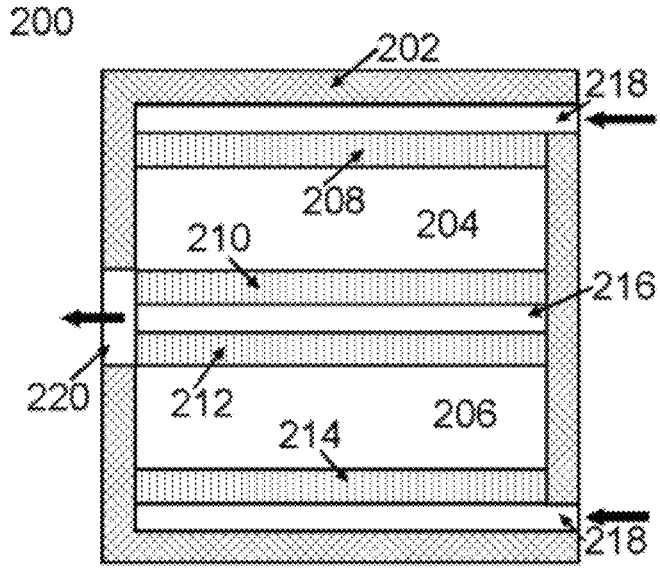

FIG. 2 depicts an alternative embodiment of a thermal transpiration driven gas pump using nanoporous ceramic elements. FIG. 2 includes encapsulation 202, first nanoporous ceramic element 204, second nanoporous ceramic element 206, first passive thermal element 208, second passive thermal element 210, third passive thermal element 212, fourth passive thermal element 214, heater 216, inlet ports 218, and outlet port 220.

The elements are similar to those as described with reference to FIG. 1. In the example of FIG. 2, the first nanoporous ceramic element 204 is disposed between the first passive thermal element 208 and the second passive thermal element 210. The second nanoporous ceramic element 204 is disposed between the third passive thermal element 212 and the fourth passive thermal element 214. Heater 216 is in thermal contact with both the second passive thermal element 210 and the third passive thermal element 212. These elements are sealed within encapsulation 202. The nanoporous ceramic elements 204 and 206 and heaters provide a molecular (or transitional) flow regime and temperature gradient, respectively, such that a gas flow is created between the inlet ports 218 and the outlet port 220 due to thermal transpiration.

Figure 3:
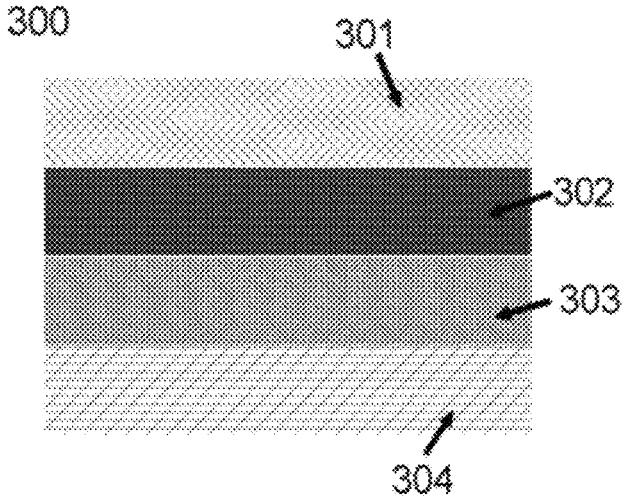
FIG. 3 depicts an example of a nanoporous ceramic element including multiple layers of one or more types of ceramic materials.

FIG. 3 depicts a diagram 300 of a nanoporous ceramic element including multiple layers of one or more types of ceramic materials. FIG. 3 includes first nanoporous ceramic layer 301, second nanoporous ceramic layer 302, third nanoporous ceramic layer 303, fourth nanoporous ceramic layer 304.

In the example of FIG. 3, the nanoporous ceramic element includes multiply stacked layers of one or more types of nanoporous ceramic materials. Stacking layers of nanoporous ceramic materials may act in favor of thermal efficiency of the device by disrupting the path of phonons moving across the thickness of the nanoporous ceramic element. In another embodiment, passive thermal elements, heaters, and/or coolers may be disposed between the stacked layers.

Figure 4:
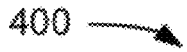
FIG. 4 depicts an alternative embodiment for the encapsulation shown in FIG. 1.
Figure 4:
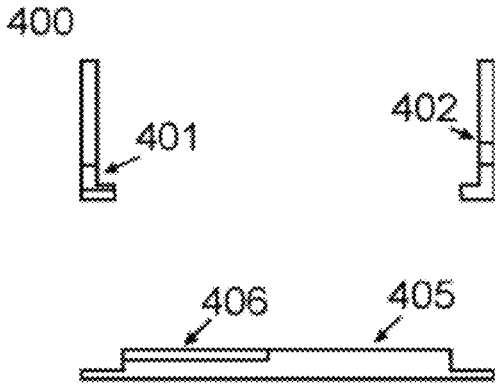

FIG. 4 depicts an alternative embodiment for the encapsulation shown in FIG. 1. The encapsulation 400 is hollowed to accommodate a thermally conductive base 405, which provides greater uniformity in temperature across the facet of the ceramic element 104. It may also serve as a heat sink that maintains the cold end of the ceramic element 104 close to room temperature. FIG. 4 includes port provisions 401 and 406, sensor provision 402, and thermally conductive base 405.

In the example of FIG. 4, port provisions 401 and 406 may be used for inlet or outlet of gas flow. Sensor provisions 402 may accommodate various sensing elements to measure, for example, the gas flow rate through the nanoporous ceramic element, the temperature, or other variables.

The thermally conductive base 405 may be used to create a temperature gradient across the nanoporous ceramic element 104. In a non-limiting example, the thermally conductive base 405 may absorb all the necessary heat from an outside source and may therefore not require a heater as described in FIG. 1. In one embodiment, thermally conductive base 405 may be connected to a cooler 108. In another embodiment, the thermally conductive base 405 may be used in combination or conjunction with a heater and/or cooler, as described with reference to FIG. 1. Thermally conductive base 405 may be made of copper, and may be used for thermal coupling of the transpiration driven gas pump with heat from an external system.

Figure 5:
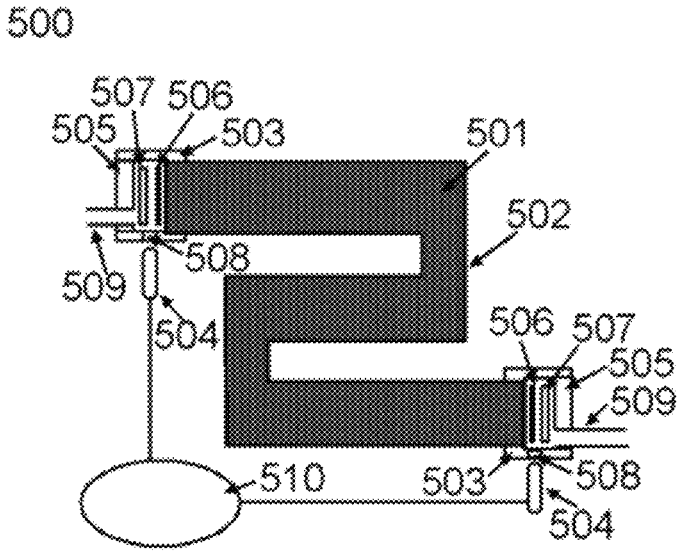
FIG. 5 depicts an example of a thermal transpiration driven gas pump that provides different flow rates for different gas molecules.

FIG. 5 depicts a diagram 500 of a thermal transpiration driven gas pump that provides different flow rates for different gas molecules. FIG. 5 includes nanoporous ceramic element 501, seal 502, encapsulations 503 and 505, sensors 504, passive thermal elements 506, heaters 507, sensor provisions 508, port provisions 509, and feedback control system 5 10.

The transpiration driven flow speeds may depend on the mass of the gas molecules and their rates of interaction with the matrix of the nanoporous ceramic element 501. This may lead to different flow characteristics for different gases. The interaction between the gas molecules and the ceramic element 501 may further be controlled by coating the surface of the matrix of the ceramic element 501. The coating may comprise of one or more types of layers of polymer that may be treated chemically.

In the example of FIG. 5, encapsulations 503 and 505, sensors 504, passive thermal elements 506, heaters 507, sensor provisions 508, port provisions 509, and feedback control system 510 are similar to those as described in reference to FIG. 1.

In the example of FIG. 5, the nanoporous ceramic element 501 is configured to provide a flow path that is long compared to the mean free path of the gas molecules. The nanoporous ceramic element 501 may be shaped in lithographically fabricated flow channels and may be sealed, as indicated by seal 502, to prevent the gas molecules from escaping through the edges of the nanoporous ceramic element 501.

The lithographically fabricated flow channels may include a micromachined recess on the surface of a glass wafer. Ends of the nanoporous ceramic element 501 may have encapsulations 503 and 505, which have provisions for inlet/outlet 509. The device encapsulations 500 may further comprise passive thermal elements 506 and heaters 507 required to reversibly control the differential pumping of the gas. Encapsulations 503 and 505 may have provisions 508 for sensors 504 that can sample temperature, pressure and flow rate of the gas sample entering and leaving the nanoporous ceramic element 501. The pressure, temperature and flow rate data may be used to provide feedback to the control system 510, which regulates the gas flow rate across the nanoporous ceramic element 501.

Figure 6:
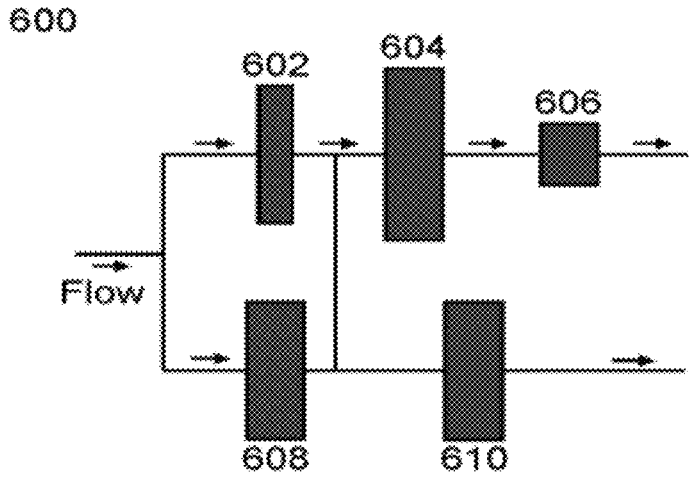
FIG. 6 depicts an example of an arrangement comprising various types of ceramic elements arranged in series or parallel along a flow path.

FIG. 6 depicts an example 600 of an arrangement comprising various types of ceramic elements arranged in series or parallel along a flow path. FIG. 6 includes nanoporous ceramic sub-elements 602-610.

In the example of FIG. 6, the nanoporous ceramic element, as described with reference to FIGS. 1 and 5, is divided into sub-elements 602-610, which may be of varying sizes, shapes and materials. Sub-elements 602-610 may or may not have independent heaters associated with them. The sub-elements 602-610 may be arranged in series along the flow path such that the gas molecules must sequentially pass through each one, or they may be arranged in parallel, such that each gas molecule may pass through only one. This arrangement may further provide a means for physically separating the flow path of certain types of molecules.

Figure 7A:
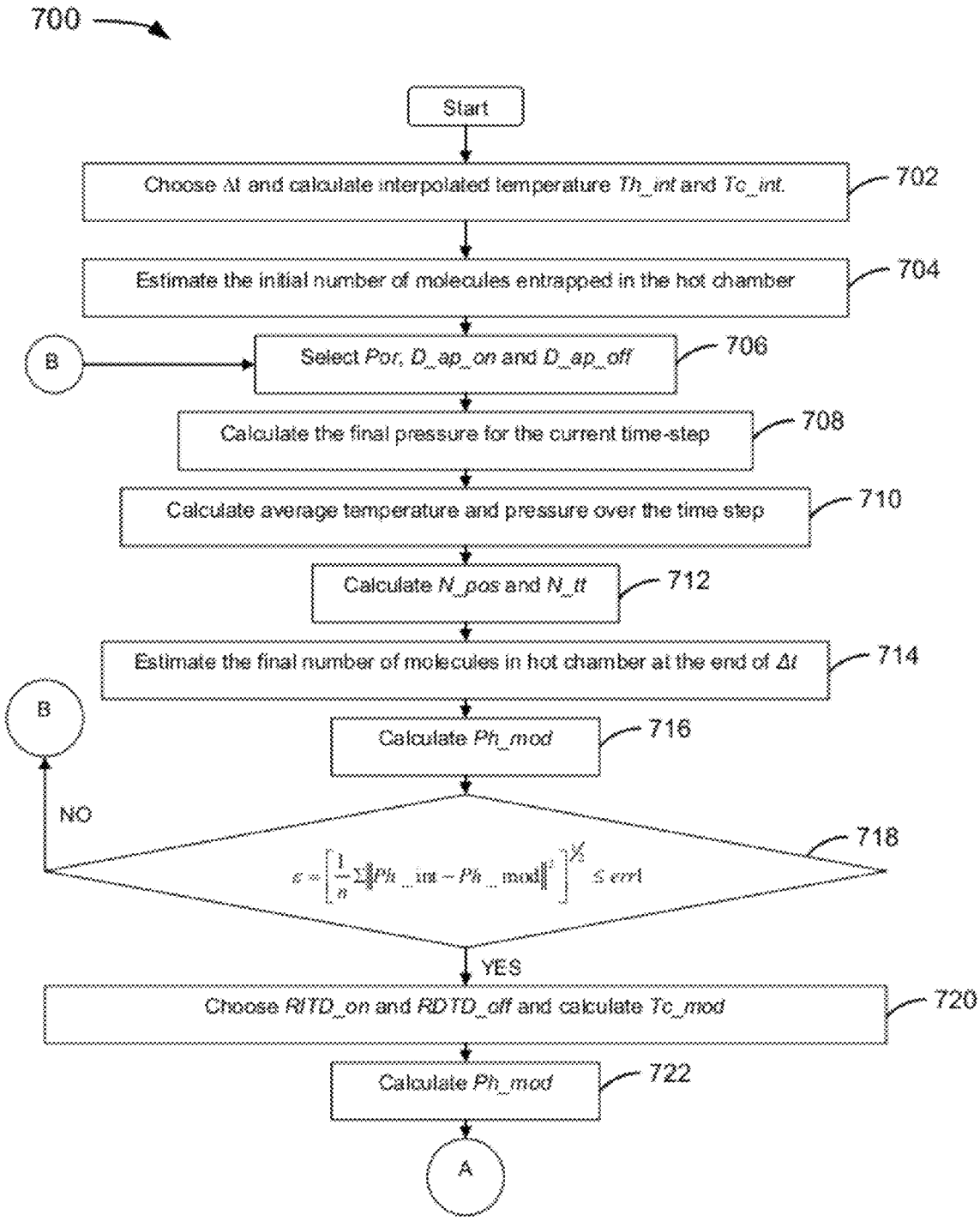
FIGS. 7A and 7B depict an example of a sequence of steps required to estimate some of the potential performance parameters for a transpiration driven Knudsen pump.
Figure 7B:
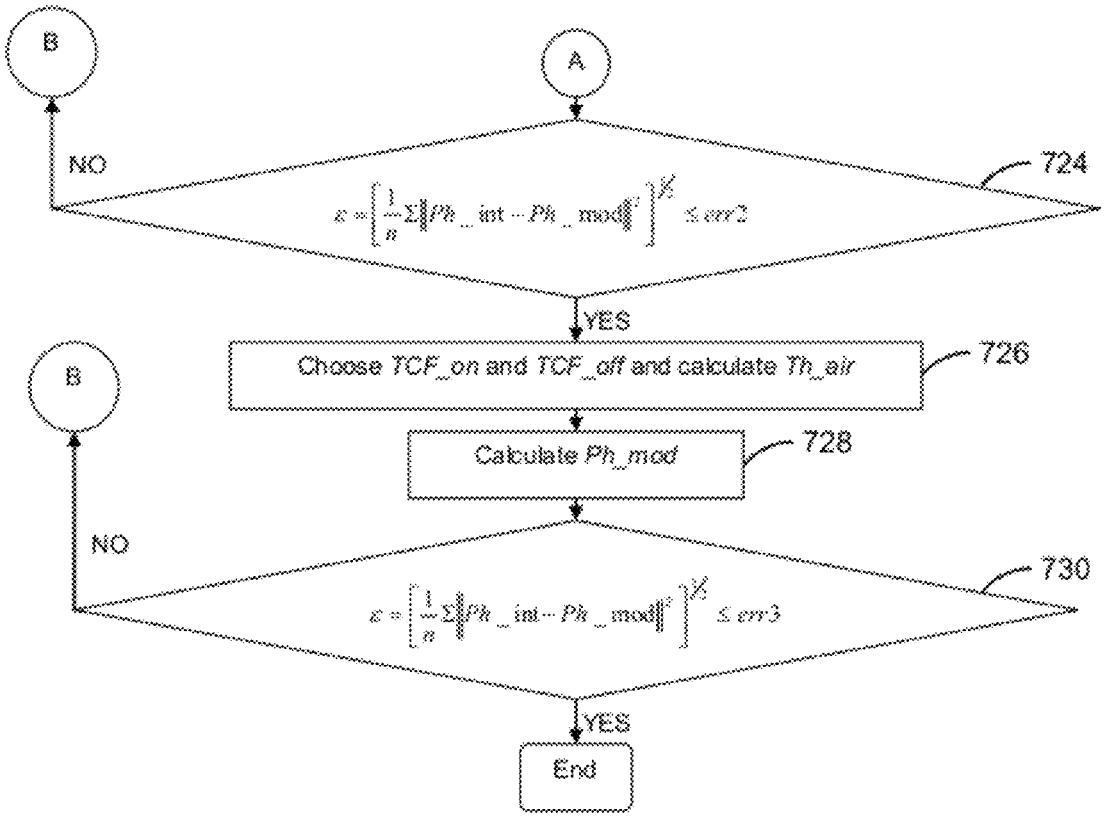

FIGS. 7A and 7B (herein referred to as FIG. 7 collectively) depict an example of a flowchart for estimating performance parameters for a transpiration driven pump. These parameters may include the percent porosity of the nanoporous ceramic element, effective leakage aperture of a defect, correction for thermal contact resistance, correction for the delay in heating of the air trapped in the hot chamber and so on.

In the example of FIG. 7, the flowchart starts at module 702 with choosing a time step (Δt) and calculating interpolated temperature in the hot chamber (Th_int) and in the cold chamber (Tc_int).

In the example of FIG. 7, the flowchart continues to module 704 with estimating the initial number of molecules entrapped in the hot chamber. The initial number of molecules relates to the dead volume (V) of the entrapped gas, its temperature (T) and pressure (P) by the correlation $$\frac{PV}{k_B T},$$

where $k_B$ is the Boltzmann constant.

In the example of FIG. 7, the flowchart continues to module 706 with selecting the percent porosity (Por) of the nanoporous ceramic element, selecting the effective aperture diameter for gas leakage through macrocracks for the duration the heater is on (D_ap_on), and selecting the effective aperture diameter for gas leakage through macrocracks for the duration the heater is off (D_ap_off). Por D_ap_on and D_ap_off may be selected such that it minimizes the least squared error between the modeled pressure in the hot chamber (Ph_mod) and the interpolated value (Ph_int) of the experimentally measured pressure (Ph_exp) in the hot chamber. Ph_int may be a cubic interpolation of Ph_exp of the form $e.t^3+f.t^2+g.t+h=Ph_int$, where the coefficients e, f, g and h may depend on Ph_exp.

In the example of FIG. 7, the flowchart continues to module 708 with calculating the final pressure for the current time step. The final pressure may depend on the temperature rise over the duration Δt.

In the example of FIG. 7, the flowchart continues to module 710 with calculating the average temperature and pressure over the time step. The average temperature and pressure may be assumed to be the average temperature and pressure over current time period for the purpose of subsequent calculation over this time step.

In the example of FIG. 7, the flowchart continues to module 712 with calculating the number of molecules (N_pos) leaking out of the hot chamber through the aperture by virtue of Poiseuille's law over the time Δt, and calculating the number of molecules (N_tt) pumped into the hot chamber due to thermal transpiration flow across the nanopores of the ceramic element over the time Δt. This accounts for the transpiration flow due to temperature gradient and back flow due to the pressure gradient. The calculation of N_pos and N_tt may use average temperature and pressure over the current time step.

In the example of FIG. 7, the flowchart continues to module 714 with estimating the final number of molecules in the hot chamber at the end of Δt. The final number of molecules after time step Δt may be given by the algebraic sum of N_pos, N_tt and the initial number of molecules in the hot chamber.

In the example of FIG. 7, the flowchart continues to module 716 with calculating the modeled pressure in the hot chamber (Ph_mod). P_mod at a particular time-step may depend on the number of molecules remaining the chamber, temperature and pressure.

In the example of FIG. 7, the flowchart continues to module 718 with determining:

$$\varepsilon = \left[\frac{1}{n}\Sigma\|\text{Ph_int} - \text{Ph_mod}\|^2\right]^{\frac{1}{2}} \le err1,$$

where ϵ is the root mean square deviation of Ph_mod with respect to Ph_int, n is the total number of interpolation points, and err1 is the tolerance limit on the root mean square deviation.

If the decision at module 718 is yes, then the flowchart continues to module 720 with choosing the rate of increase of temperature difference (RITD_on) between Tc_mod and Tc_exp for the duration when heater is on, choosing the rate of decrease of temperature difference (RDTD_off) between Tc_mod and Tc_exp for the duration when heater is off, and calculating Tc_mod. Due to thermal contact resistance Tc_mod is expected be higher than Tc_exp at all times. RITD_on and RDTD_off represent the loss in the performance due to the thermal contact resistance.

In the example of FIG. 7, the flowchart continues to module 722 with calculating the modeled pressure in the hot chamber (Ph_mod). Ph_mod at this step accounts for the loss in performance due to the thermal contact resistance.

In the example of FIG. 7, the flowchart continues to module 724 with determining:

$$\varepsilon = \left[\frac{1}{n}\Sigma\|\text{Ph_int} - \text{Ph_mod}\|^2\right]^{\frac{1}{2}} \le err2,$$

where ϵ is the root mean square difference between Ph_mod and Ph_int, and err2 is the tolerance limit on the root mean square deviation.

If the decision at module 724 is yes, then the flowchart continues to module 726 with choosing the factor (TCF_on) by which the time constant of heating of air is higher than Th_exp for the duration when heater is on, choosing the factor (TCF_off) by which the time constant of heating of air is higher than Th_exp for the duration when heater is off, and calculating the modeled temperature of air in the hot chamber (Th_air). TCF_on and TCF_off account for the delay in heating and cooling of air molecules, entrapped in the hot chamber, with respect to the heater itself.

In the example of FIG. 7, the flowchart continues to module 728 with calculating the modeled pressure in the hot chamber (Ph_mod). Ph_mod at this step accounts for the delay in the heating of the air in the hot chamber.

In the example of FIG. 7, the flowchart continues to module 730 with determining:

$$\varepsilon = \left[\frac{1}{n}\Sigma\|\text{Ph_int} - \text{Ph_mod}\|^2\right]^{\frac{1}{2}} \le err3,$$

where ϵ is the root mean square difference between Ph_mod and Ph_int, and err3 is the tolerance limit on the root mean square deviation. These deviations are representative numbers for variation of between Ph_mod as compared to Ph_int in these steps.

If the decision at module 730 is yes, then the flowchart terminates. If the decision at module 718, 724, or 730 is no, then the flowchart continues to module 706.

Figure 8:
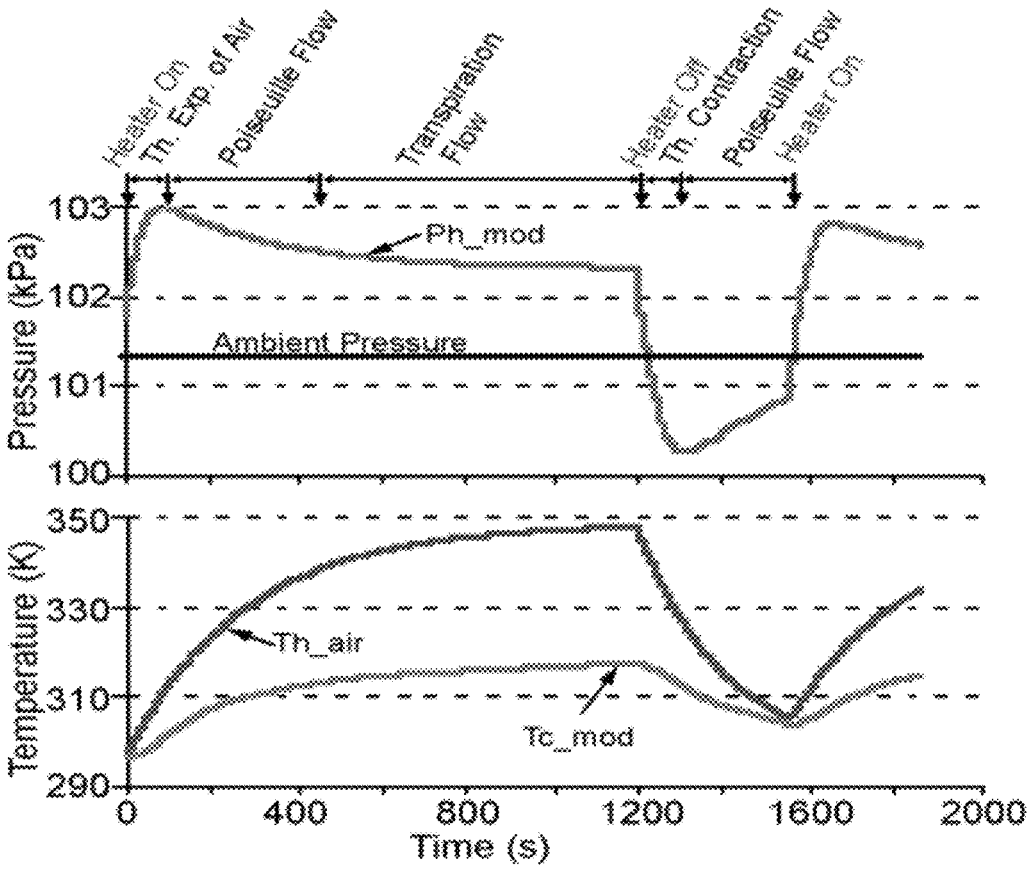
FIG. 8 depicts the modeled pressure in the hot chamber.

FIG. 8 depicts the modeled pressure in the hot chamber (Ph_mod) as determined by a method as described with reference to FIG. 7. Ph_mod takes into account some of the performance parameters, such as defects in the ceramic matrix, effect of delay in the heating of the air entrapped in hot chamber (Th_air), elevated temperature at the cold end of the ceramic element due to the thermal contact resistance (Tc_mod) and so on.

Figure 9:
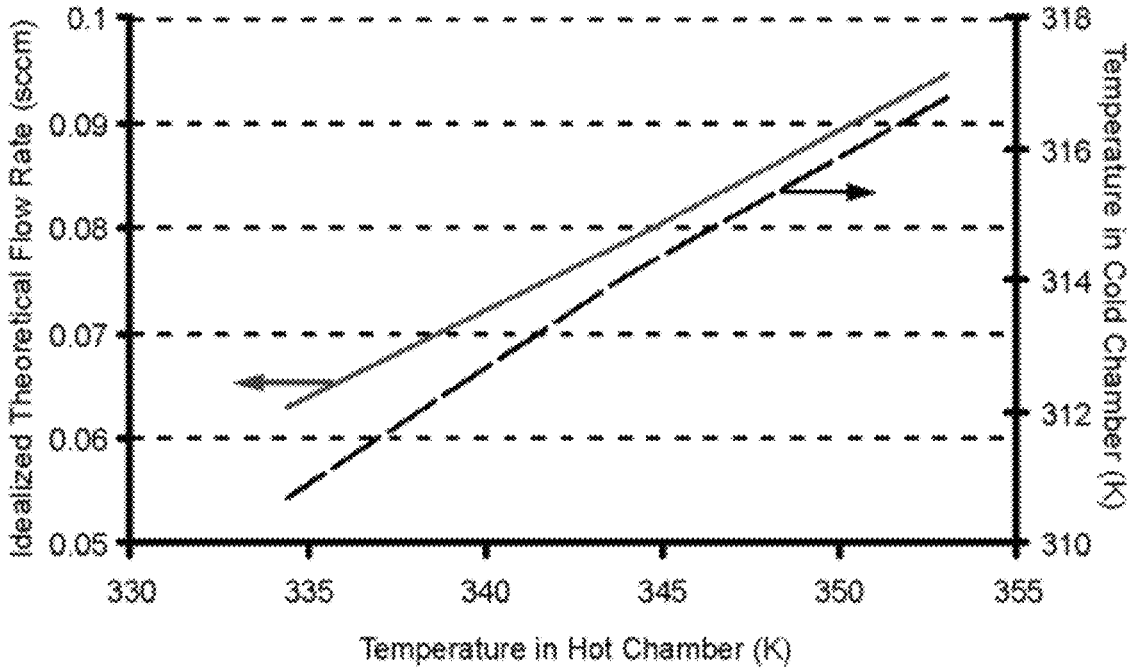
FIG. 9 depicts the idealized theoretical mass flow rate of air across a zeolite element subject to a given temperature drop across its thickness.

FIG. 9 depicts the idealized theoretical mass flow rate of air across a zeolite element (48 mm in diameter and 2.3 mm thick) subject to a given temperature drop across its thickness. The predictions are based on a semi-analytical model for gas flow in the free molecular and transitional flow regimes.

According to a known model, the average mass flow rate across a narrow channel, by the virtue of thermal transpiration, is given by:

$$\dot{M}_{avg} = \left(Q_T\frac{T_h - T_c}{T_{avg}} - Q_P\frac{P_h - P_c}{P_{avg}}\right)\frac{\pi a^3 P_{avg}}{l}\left(\frac{m}{2k_B T_{avg}}\right)^{\frac{1}{2}} \quad (2)$$

where $T_h$ and $P_h$ are the temperature and pressure on the hot end of the nanoporous channel, $T_c$ and $P_c$ are the temperature and pressure on the cold end of the nanoporous channel, $T_{avg}$ and $P_{avg}$ are the average temperature and pressure in the nanoporous channel, m is mass of a gas molecule, $k_B$ is the Boltzmann constant, a is the hydraulic radius of the narrow tube, and l is the length of the nanoporous channel. $Q_P$ and $Q_T$ are the pressure and temperature coefficients that depend on rarefaction parameter $\delta_{avg}$ given by $$\delta_{avg} = \left(\frac{\pi^3}{2}\right)^{\frac{1}{2}}\frac{aD^2 P_{avg}}{k_B T_{avg}} \quad (3)$$

where D is the collision diameter of the gas molecules under consideration.

The analytical model described above, coupled with various performance parameters, may be used to describe a representative simulation model for thermal transpiration pumping through the nanoporous ceramic element.

The simulation model also serves as a platform for benchmarking various material properties and design features that may affect the performance of a transpiration driven gas pump. These include, for example:

The percentage porosity of the ceramic element Por and the effective diameter of the leak aperture D_ap_on or D_ap_off are two of the most important parameters that may affect the steady state pressure attained by the device.

Loss in performance due to the thermal contact resistance may play a major role in the deterioration of transpiration based gas pumping in continuous operation.

The time constants of heating and cooling of the air entrapped in the hot chamber of the device may cause an initial pressure spike that occurs before the pressure down to a steady state value.

A single stage transpiration driven gas pump, with 48 mm diameter and 2.3 mm thick zeolite element, subjected to a temperature gradient of 15.7 K/mm may produce a flow rate of approximately 0.1-10 ml/min against a back pressure of about 50 Pa offered by a typical measurement set-up. The matrix of the zeolite element, which is assumed to have pore diameter 0.45 nm and porosity (Por) of 34%, may have structural defects or leakage through the seals that would be accounted for by the effective leakage aperture (D_ap_on and D_ap_off).

While operating with sealed outlet, a typical variation of pressure in the hot chamber (Ph_mod) may appear as in FIG. 8. This transient pressure profile, which is primarily dependent on thermal transpiration flow across the zeolite element, corresponds to the variation of temperature in the hot and the cold chambers. The temperature in the cold chamber is assumed to regulate the temperature at the cold end of the zeolite (Tc_mod). This temperature rise over time is due to the thermal contact resistance at the interface of various thermal elements. The temperature at the hot end of the zeolite is assumed to be regulated by the bulk air temperature (Th_air) entrapped in the hot chamber. The matrix of the zeolite element is assumed to have pore diameter 0.45 nm and porosity (Por) of 34%. Further, the zeolite matrix is assumed to have effective leak aperture diameters (D_ap_on and D_ap_off) of about 20 μm, which may be due to structural defects in the matrix of the zeolite element or due to the leakage through the seals.

During the intial phases of the device operation, thermal expansion of the gas entrapped in the hot chamber may be more prominent, which would result in a sharp rise in the pressure in the hot chamber (FIG. 8). The pressure rise due to the thermal expansion of gas would be subsequently neutralized by the Poiseuille flow that may be responsible for the backflow of gas molecules from hot chamber to the cold chamber. Finally, while operating in steady state, thermal transpiration would be the dominant phenomenon and it would result in a higher steady state pressure. As soon as the heater is turned off the transpiration driven flow would cease and hence the Poiseuille flow may play a dominant role in equilibrating the pressure between the hot chamber and the ambient.

The pressure profile (Ph_mod), as predicted by the simulation model (based on the algorithm presented in FIG. 8), takes into account the design and material choices and assumptions listed above, and may be representative of a typical experimentally observed pressure (Ph_exp), such that the root mean square deviation (err1, err2 and err3) between the two is on the order of 1 kPa. The root mean square deviations err1, err2 and err3 serve as the convergence criteria for various simulation steps.

A semi-analytical model for the gas flow in free molecular and transitional flow regime may be used to estimate the idealized pumping efficiency of the transpiration driven gas pump. FIG. 9 suggests that under idealized conditions a 2.3 mm thick zeolite element with 48 mm diameter may generate a flow rate of about 0.1 sccm for a temperature drop of about 38 K. The idealized model assumes: (a) perfect structure of zeolite, which has no macro cracks, (b) perfect thermal contact at all interfaces, (c) uniform in-plane temperature, (d) negligible flow resistance offered by all other elements, except the zeolite element.

The model may be further used to estimate the idealized differential pumping capabilities of a Knudsen pump. The model predicts that for a temperature gradient of about 15.7 K/mm across the zeolite element, the hydrogen gas molecules, which are two and a half times smaller than nitrogen molecules, are pumped about four times faster. Moreover, Poiseuille flow may also provide a mechanism for differential pumping within the zeolite element. Under idealized conditions, for pressure driven flow of 21 kPa/mm across the zeolite element, with zero temperature gradient, hydrogen molecules are expected to move four times faster than nitrogen molecules.

What is claimed is:

1. A device comprising:

at least one nanoporous ceramic element with an average pore size between 0.3 nm and 10 nm, wherein gas flows through the nanoporous ceramic element in a non-viscous flow regime;

an enclosure containing said nanoporous ceramic element; and heating or cooling means on one side of the nanoporous ceramic element.

2. The device of claim 1, wherein the device is configured to create a pressure differential in a sealed chamber when said device is enclosed in said sealed chamber.

3. The device of claim 1, wherein said enclosure has an opening to enable gas to flow through said nanoporous ceramic element.

4. The device of claim 1, wherein said enclosure has at least two openings to enable gas to flow through said nanoporous ceramic element.

5. The device of claim 1, wherein the nanoporous ceramic element includes zeolites.

6. The device of claim 1, wherein the Knudsen number associated with the average pore size of the nanoporous ceramic element is greater than 0.1.

7. The device of claim 1 , wherein said heating or cooling means are configured to provide a temperature gradient.

8. The device of claim 7 further comprising one or more sensors disposed on one or more further positions in proximity to said nanoporous ceramic element, wherein said sensors measure at least one of: temperature, pressure, or gas flow through the device.

9. The device of claim 8 further comprising a feedback control, wherein said sensors measure at least the gas flow through the device, further wherein the feedback control is configured to control said heating or cooling means as a function of the gas flow through the device.

10. The device of claim 9, wherein the nanoporous ceramic element is disposed in a flow channel which has a length greater than its effective diameter.

11. The device of claim 1, further comprising a gas with molecules of more than one size, wherein a flowrate of said molecules depends on the size of the molecules.

12. The device of claim 1, wherein the nanoporous ceramic element includes an arrangement of nanoporous ceramic sub-elements, wherein said nanoporous ceramic sub-elements are arranged in series and/or parallel.

13. A transpiration driven gas pump comprising:

a first thermal element;

a second thermal element;

a nanoporous ceramic element disposed between the first thermal element and the second thermal element;

a heating element connected with said first thermal element;

wherein the nanoporous ceramic element has an average pore size such that a gas substantially at an atmospheric pressure flows through the nanoporous ceramic element in a non-viscous flow regime;

wherein the first thermal element and second thermal element are configured to allow a gas to flow through the first thermal element and second thermal element; and wherein, the heating element provides a heat gradient between the first thermal element and the second thermal element.

14. The transpiration driven gas pump of claim 13, wherein the nanoporous ceramic element includes zeolites.

15. The transpiration driven gas pump of claim 13 further comprising:

a third thermal element;

a fourth thermal element;

a second nanoporous ceramic element disposed between the first thermal element and the second thermal element; and wherein the third thermal element is connected with the heating element.

* * * * *